US010726666B2

(12) United States Patent
Martineck, Sr. et al.

(10) Patent No.: US 10,726,666 B2
(45) Date of Patent: Jul. 28, 2020

(54) SCRATCH-OFF LOTTERY TICKET SYSTEM AND METHOD WITH FOREIGN LANGUAGE TEMPLATES

(71) Applicant: Scientific Games International, Inc., Newark, DE (US)

(72) Inventors: Jeffrey D. Martineck, Sr., Johns Creek, GA (US); Russ Joiner, Chamblee, GA (US)

(73) Assignee: SCIENTIFIC GAMES INTERNATIONAL, INC., Newark, DE (US)

( * ) Notice: Subject to any disclaimer, the term of this patent is extended or adjusted under 35 U.S.C. 154(b) by 204 days.

(21) Appl. No.: 15/958,141

(22) Filed: Apr. 20, 2018

(65) Prior Publication Data

US 2019/0325698 A1 Oct. 24, 2019

(51) Int. Cl.
*G07F 17/32* (2006.01)

(52) U.S. Cl.
CPC ..... *G07F 17/3227* (2013.01); *G07F 17/323* (2013.01); *G07F 17/329* (2013.01); *G07F 17/3223* (2013.01)

(58) Field of Classification Search
CPC ..... G07F 17/329
See application file for complete search history.

(56) References Cited

U.S. PATENT DOCUMENTS 3,918,174 A 11/1975 Miller et al.
4,734,036 A 3/1988 Kasha
7,590,950 B2 9/2009 Collins et al.
8,434,792 B2 5/2013 Martineck, Sr.
9,424,252 B2 * 8/2016 Takaoka ..... G06F 17/28
2003/0181235 A1 * 9/2003 Bennett, III ..... G06Q 20/3437 463/17
2005/0130736 A1 6/2005 Polak et al.
2009/0017893 A1 * 1/2009 Carson ..... G07F 17/329 463/17
2010/0069136 A1 3/2010 Safaei et al.
2014/0045568 A1 2/2014 Bennett, III et al.

OTHER PUBLICATIONS

EPO Search Report, dated Aug. 19, 2019.

* cited by examiner

*Primary Examiner* — David L Lewis
*Assistant Examiner* — Ross A Williams
(74) *Attorney, Agent, or Firm* — Dority & Manning, P.A.

(57) ABSTRACT

An instant lottery ticket game system and method wherein a master instant lottery tickets for a common game a game play area with variable game play indicia, and static game instruction indicia in a master language. Each master ticket includes a code thereon that links the master ticket to the common game. For the common game, one or more corresponding digital templates are provided that contain the static game instruction indicia in a different foreign language. A central server stores the digital templates and downloads the templates to a player's smart device. Via an application on their smart device, the player enters the code from the master instant lottery ticket and selects one of the digital templates to view the game instruction indicia in the foreign language of the digital template.

18 Claims, 8 Drawing Sheets

SCRATCH-OFF LOTTERY TICKET SYSTEM AND METHOD WITH FOREIGN LANGUAGE TEMPLATES

FIELD OF THE INVENTION

The present invention generally relates to a system and method for implementing a scratch-off ("instant") lottery ticket game, and more particularly to a method and system for facilitating multi-lingual play of such games.

BACKGROUND

"Scratch-off" or "instant-win" lottery tickets have enjoyed immense popularity in the lottery industry for decades. These games offer distinct advantages to the lottery authorities and are attractive to a broad spectrum of players. Typically, the tickets are printed in the primary language of a targeted population base. For example, the same themed ticket may be printed in different runs in English, Spanish, German, and so forth, depending on the intended country or other distribution locale.

However, as the population base grows more culturally diverse, particularly in larger metropolitan areas, one single language may no longer be dominant over a broad population spectrum. Entire sections or neighborhoods of a city or other locale may speak one language, while an adjacent neighborhood primarily speaks an entirely different language. The residents of these neighborhoods may not be comfortable with the other respective language. This pertains to play of lottery tickets in differing languages as well. Persons who are not fluent or comfortable with the language of the scratch-off ("instant") lottery ticket may avoid playing the game for fear of not understanding the game rules or, even worse, not recognizing that their ticket may actually be a winning ticket. As the games continue to add greater prizes and more complex entertainment features, the reluctance to play by those not comfortable with the language of the ticket will correspondingly grow.

In the past, it has not been economically or commercially feasible to provide a multi-lingual game card or lottery ticket. The available surface area on a scratch-off ticket (often referred to as the ticket "real estate") for the various game features, such as a game play area, instructions, security features, graphics, and so forth, is limited and cannot reasonably accommodate repetition of the pertinent game rules or instructions in different languages. Essentially, the only option was to provide separate production runs of tickets in the different languages.

U.S. Pat. No. 8,434,792 proposes a solution wherein a game on a single paper game card includes a game play area, and a first set of game instructions provided on the game card printed in a first language. A second set of the game instructions in a different second printed language is superimposed over the first set of game instructions. An indicator is provided on the game card to convey that the first set of game instructions are present and accessible by removing the second set of game instructions. Thus, the player has the option to read the game instructions in either or both of the first or second printed languages. Although this is a useful method and system, it requires substantial additional printing time, expenses, and materials.

The industry and public would benefit from still more improved methods to facilitate multi-lingual play of a game on a printed game card, such as a scratch-off lottery ticket.

SUMMARY

Objects and advantages of the invention will be set forth in part in the following description, or may be obvious from the description, or may be learned through practice of the invention.

In a particular embodiment, an instant lottery ticket game system and method includes a set of master instant lottery tickets ("master tickets") for a common game. The master instant lottery tickets may be printed paper tickets, or may be electronically simulated tickets that are transmitted to and played by the player via an application running on a smart device, such as a mobile phone, tablet, computer, etc. The master tickets are produced for a single common game, for example all of the tickets produced for a common game identified by a single name (e.g., "Lucky Seven" instant scratch-off tickets). Such tickets may be produced under multiple production runs, wherein the prize structure for the expected value of the common game is implemented by winning tickets distributed throughout the production run(s).

Each master ticket includes a game play area with variable game play indicia that determines whether or not the ticket is a winning or losing ticket. The game play indicia is variable in that it changes from one ticket to the next. The game play area is covered by a removable scratch-off coating (SOC) layer, as is well-known in the industry. Each master ticket also includes static game instruction indicia (words and graphics) that does not change and is common to all of the master tickets in the common game. This indicia generally instructs the player on how to play the game, the potential prizes, and so forth. At least some or all of the game instruction indicia is in a master language, for example English.

Each of the master tickets further includes a code thereon that links the master ticket to the common game in a database. For example, all of the master tickets in the same common game will have the same code (which may encompass the same part or identifying information in a ticket-specific code, such as a validation code).

For each common game, one or more corresponding digital templates are produced and stored in a computer-accessible file, wherein each digital template contains the static game instruction indicia in a foreign language. For example, a respective digital template may be produced and stored in Spanish, French, German, and so forth.

It should be appreciated that the term "master language" in used herein to refer to the language of the primary printed or electronic ticket master ticket, and is not limited to any particular language. The term "foreign language" is used herein to refer to any language that is different than the master language.

A central server initially stores the digital templates for the common game, and is configured for communication with a player's smart device to download the digital templates via an application running on the player's smart device. In one embodiment, the digital templates for one or more of the common games are downloaded and stored on the player's smart device before the player even purchases a master ticket. For example, the digital templates may be downloaded to the player's smart device with the application. Upon entry of the code from the master ticket into the smart device, the application makes the stored digital templates available.

In an alternate embodiment, the digital templates are not downloaded and stored in the player's smart device, but are individually transmitted by the central server to the smart device upon receipt of the code from the smart device.

With the above system and method, the player enters (scans or otherwise inputs) the code from the master ticket into their smart device via the application on the device. The player is then provided with the option to select one of the digital templates stored on their smart device to view the game instruction indicia in the foreign language of the digital template.

In a particular embodiment, the digital templates are presented on the player's smart device as static non-interactive images. In other words, the player does not interact with the images in order to play the game or otherwise reveal the outcome of the game. With this embodiment, the digital templates may be presented as part of a generic instant lottery ticket image for the common game. For example, the digital template may be combined with a generic game play area to represent a complete ticket.

The code on each master ticket may serve only as a game-specific code for the common game, and not be specific to individual master instant lottery tickets within the common game. However, each master ticket may also include a separate ticket-specific code, such as a validation code that is linked to a validation file associated with the master ticket at the central server. As generally understood in the industry, the validation file contains ticket-specific information for validation and pay-out (redemption) of the master ticket.

In still another embodiment, the code can also be a ticket-specific code that also links the master instant lottery ticket to a ticket-specific file at the central server. For example, such a code may contain the common game identification data and the ticket specific data. A validation code (or modified validation code) may serve this function. The ticket-specific file can include a digital game play area corresponding to the game play area on the master ticket, wherein upon receipt of the ticket-specific code, the central server transmits the digital game play area to the player's smart device where the digital game play area is combined with the digital template and presented to the player as a complete digital counterpart to the master ticket. With this embodiment, the digital game play area may interactive, wherein the application on the player's smart device may also enable simulated play (e.g., simulated removal of a digital SOC layer) of the digital ticket on the smart device to reveal the winning or losing status of the master ticket. This embodiment is also particularly useful when some or all of the variable game play indicia on the master instant lottery ticket is in the master language. The digital game play area can include such indicia in the foreign language selected by the player.

In the above embodiment, the ticket-specific code may be the ticket validation code that is also linked to a validation file associated with the master ticket at the central server, wherein the digital game play areas are stored in the validation file.

The system and method also contemplate that each of the master instant lottery tickets is specifically configured to include an easily recognized symbol printed thereon that indicates to players that one or more of the foreign language digital lottery tickets is available for the master instant lottery ticket. For example, such symbol may be a multinational caricature, similar to the Olympic Games characters and mascots.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Figure 1A:
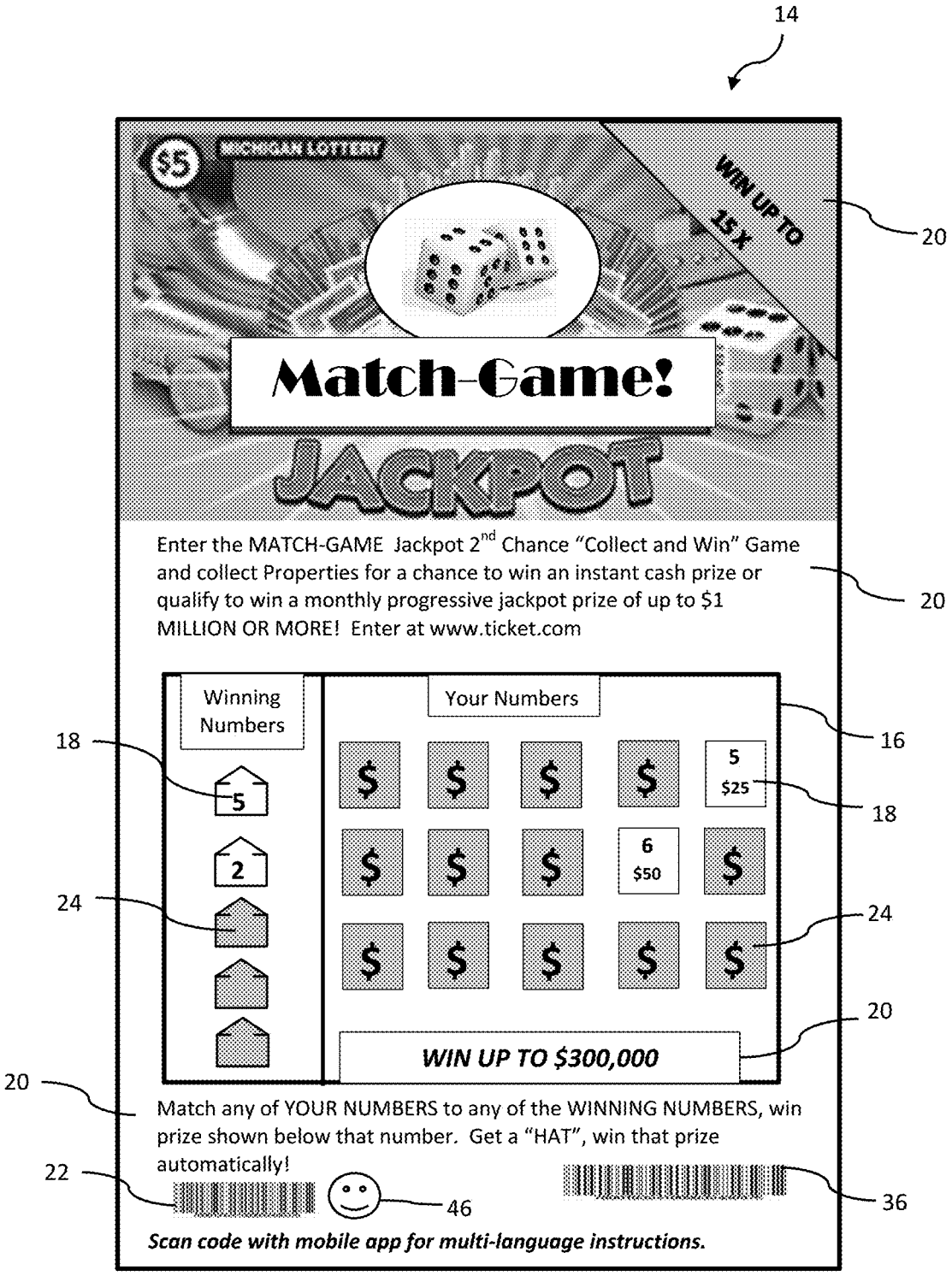
FIG. 1*a* depicts a master instant lottery ticket in a master language (English) that may be used with the game systems and methods according to an exemplary embodiment of the present invention.

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Generally, the present disclosure is directed to a computer-based instant lottery ticket game system and associated method that enable multi-language play of a master ticket without printing various foreign language tickets or producing the master tickets with expensive additional printing layers or techniques. The system and method should have appeal to players for its ease of operation and foreign language versatility.

In a particular embodiment depicted in the figures, an instant lottery ticket game system 10 (FIGS. 3 and 4) and associated method 100, 200 (FIGS. 5 and 6) are provided wherein a set 12 of individual master instant lottery tickets 14 ("master tickets") are produced. Those skilled in the art appreciate that a set 12 of such tickets 14 may be the entire lot of tickets 14 (produced over the course of one or more production runs) for a given common game, wherein the prize structure that generates the expected value for the common game is embodied by winning tickets 14 distributed throughout the ticket lot. In other embodiments, the set 12 may be a subset of the entire lot of tickets 14 for the game.

Referring to FIG. 1, an exemplary master ticket 14 is depicted. The master ticket 14 includes game instruction graphics and indicia 20 printed in a master language, such as English. Such indicia 20 explains to a player in the master language how to play the game embodied on the master ticket 14, as well as what constitutes a winning ticket and the prize amounts. The game instruction indicia 20 may be considered as "static" indicia in that, for a given common game, it does not change from one ticket 14 to the other. Thus, the set 12 of master tickets 14 are for a common game that has the same game instruction indicia 20. For example, in the depicted embodiments, the common game is a "Match-Game Jackpot" instant scratch-off lottery game.

The master tickets 14 may be printed paper tickets, or may be electronically simulated tickets 14 that are transmitted to and played by the player via an application running on a smart device 34 (FIGS. 1*b* and 2*b*), such as a mobile phone, tablet, computer, etc.

Figure 2A:
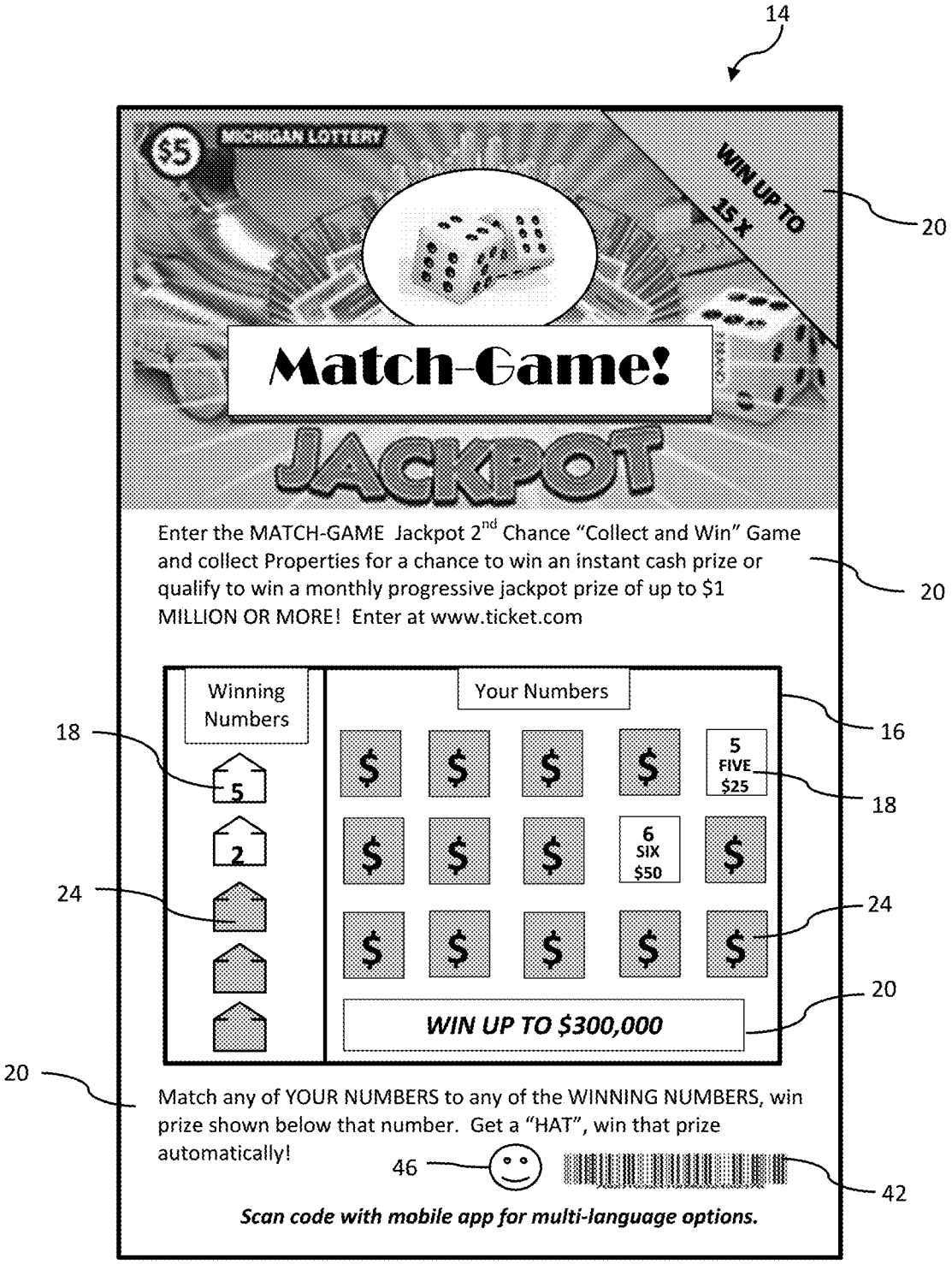
FIG. 2*a* depicts an alternate embodiment of an English-language master instant lottery ticket.

Still referring to FIGS. 1*a* and 2*a*, and as is well-known to players of instant scratch-off lottery tickets, each master ticket 14 includes a game play area 16 wherein variable game play indicia 18 is provided and covered by a scratch-off coating (SOC) layer 24. In order to reveal the winning or losing status of the master ticket 14, the player removes the SOC layer 24 to uncover the underlying game play indicia 18. Thus, the game play indicia 18 is "variable" indicia in that it changes from one master ticket 14 to another. In the depicted common game embodied by the master tickets 14 in the figures, the player is presented with a series (5) of "Winning Numbers" in the left-hand side of the game play area 16 covered by the SOC layer 24. A matrix of "Your Numbers" is provided in the right-hand side of the game player area 16. The master language game instruction indicia 20 conveys to the player that a match of any of the "Your Numbers" with any of the "Winning Numbers" wins the prize show below the number, as well as other prize potentials. Additional game instruction indicia 20 instructs the player on how to enter a second-chance game.

In the embodiment of FIG. 1*a*, each master ticket 14 includes a code 22 printed thereon, such as a scannable barcode (as depicted in the figures) or alpha-numeric code. The code 22 is a code that links or associates the master ticket 14 to the common game in a database (which may be in the player's smart device 34 or a remote central server 50, as described in greater detail below). For example, all of the master tickets 14 in the same common game will have the same (functional) code 22. It should be appreciated that the code 22 encompasses the same game identifying portions or components a ticket-specific code, such as a validation code.

Generally, conventional instant lottery tickets include a validation code 36 printed thereon, which may also be covered by a SOC layer 24, that links the ticket to a validation file 38 (FIG. 4) contained in the central server 50 (or otherwise accessible by the central server 50). Those skilled in the art appreciate that the validation file 38 contains ticket-specific information for validation and payout on the master ticket 14. In the embodiment depicted in FIG. 1*a*, the code 22 is separate from the validation code 38, which may be desirable for security reasons.

For each common game, one or more corresponding digital templates 26 (FIGS. 1*b* and 2*b*) are produced, and may be initially stored in a database at the central server 50 (or database accessible by the central server 50). Each digital template 26 contains the static game instruction indicia 20 from the master ticket 14 in a foreign language. For example, four digital templates 26 may be generated in Spanish, French, German, and Italian, respectively.

As mentioned above, the term "master language" in used herein to refer to the language of the primary printed or electronic ticket master ticket, and is not limited to any particular language. The term "foreign language" is used herein to refer to any language that is different than the master language.

Figure 3:
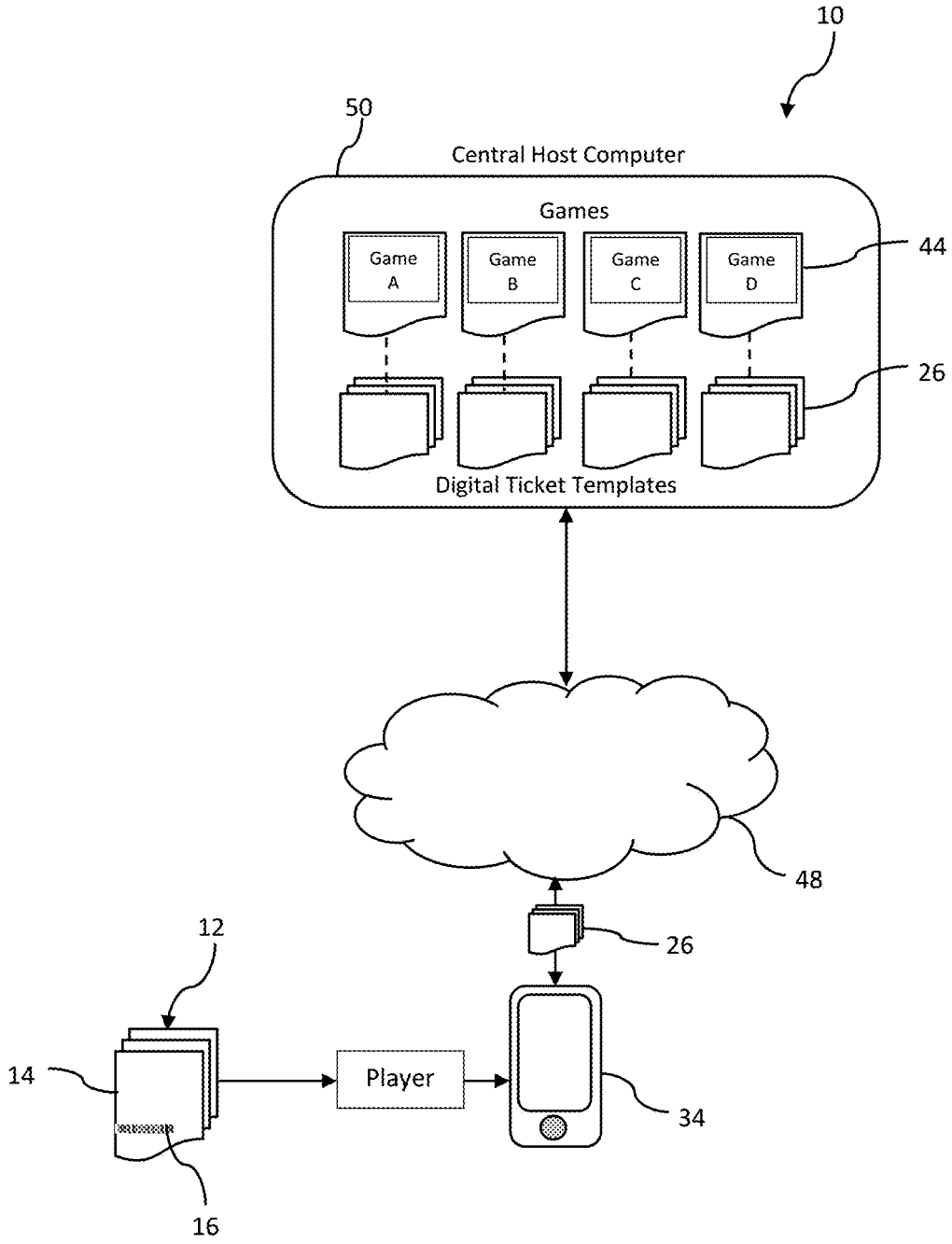
FIG. 3 is a block diagram of a system component and method configuration according to an embodiment of the invention.

Referring to FIG. 3, the central server 50 initially stores the foreign-language digital templates 26 for each common game (e.g., common games A-D), and is configured for communication with the player's smart device 34 to download the digital templates 26 via the application running on the player's smart device 34, wherein the digital templates 26 are then stored on the player's smart device 34. This download of digital templates 26 for one of the common games may happen at the first instance when the player enters the code 22 from a master ticket 14 associated with the common game. Alternately, the download of templates 26 for one or more of the common games may happen automatically with periodic updates to the application loaded on the player's smart device 34, or when initiated by the player, or may be downloaded with the initial application and periodically updated.

In an alternate embodiment, the digital templates 26 are not downloaded and stored in the player's smart device 34, but are individually transmitted by the central server 50 to the smart device upon receipt of the code 22 from the smart device 34.

With the above system 10 and method 100, 200, the player enters (scans or otherwise inputs) the code 22 from the master ticket 14 into their smart device 34 via the application on the device 34. The player is then provided with the option to select one of the digital templates 26 stored on their smart device 34 or available from the central server 50 to view the game instruction indicia in the foreign language of the digital template 26.

Figure 1B:
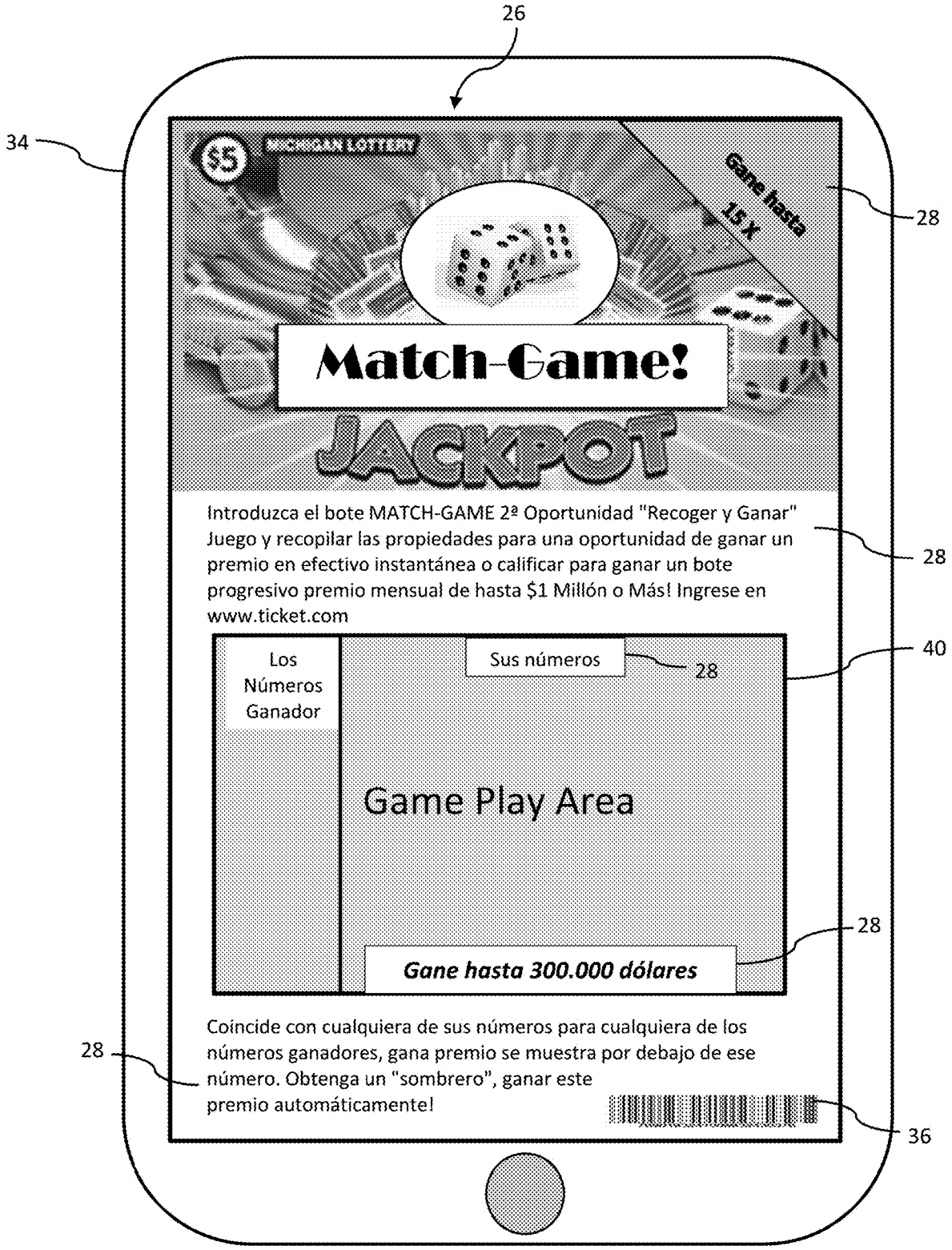
FIG. 1*b* depicts an image of a corresponding digital template with a generic game play area in a foreign language (Spanish) on a user's mobile smart device.

In a particular embodiment depicted in FIG. 1*b*, the digital template 26 is presented on the player's smart device 34 as a static non-interactive image, wherein the player does not interact with the images in order to play the game or otherwise reveal the outcome of the master ticket 14. With this embodiment, the digital template 26 may be presented as part of a generic instant lottery ticket image corresponding to the master ticket 14, wherein the digital template 26 is combined with a generic game play area 40, as depicted in FIG. 1*b*.

Figure 2B:
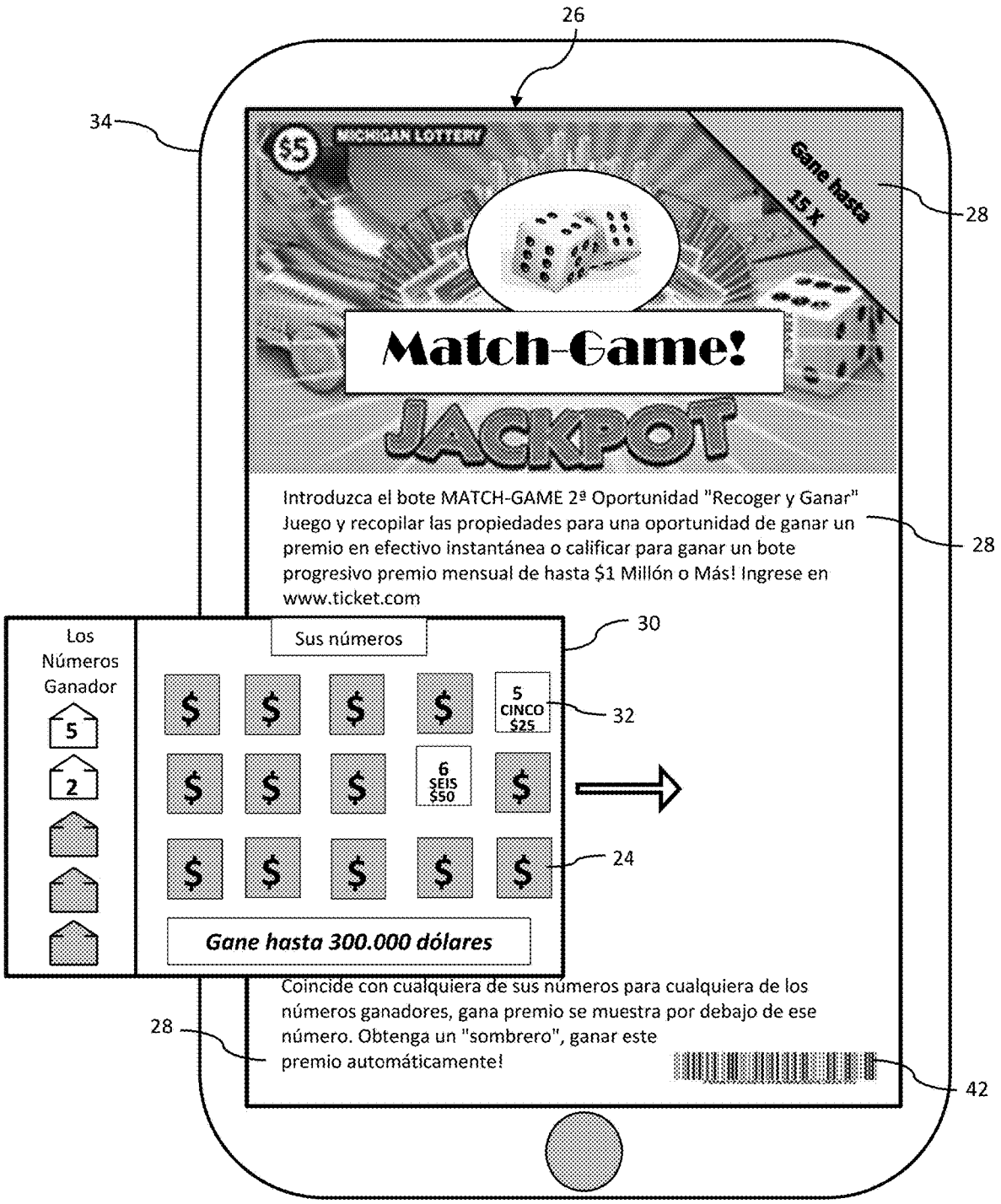
FIG. 2*b* depicts an image of a corresponding digital lottery ticket in a foreign language (Spanish) on a user's mobile smart device, wherein the digital lottery ticket incorporates an interactive game play area combined with a foreign language digital template.

In the embodiment depicted in FIG. 2*a*, the code is embodied as a ticket-specific code 42 that also links the master ticket 14 to a ticket-specific file 38 at the central server 50. For example, the code 42 may contain the common game identification data and the ticket specific data. A validation code (or modified validation code) may serve this function, as depicted in FIG. 2*a*. This embodiment may be useful when the master ticket 14 includes game play indicia 18 in the master language. For example, as depicted in FIG. 2*a*, the game play indicia 18 on the master ticket 14 may also include indicia in the master language, such as the words "five" and "six" as depicted in the figures. The ticket-specific file 38 can include a digital game play area 30 (FIG. 2*b*) that corresponds to the game play area 16 on the master ticket 14 with the game play indicia 20 from the master ticket 14 presented as foreign-language game play indicia 32. With this embodiment, upon receipt of the ticket-specific code 42 (which may be the validation code or modified validation code), the central server 50 retrieves and transmits the digital game play area 30 to the player's smart device 34. The corresponding digital template 26 can also be transmitted by the central server 50 from the respective common game file 44 or retrieved from the digital templates 26 previously downloaded to the smart device. 34. With the application running on the smart device 34, the digital game play area 30 is combined with the digital template 26 and presented to the player as a complete digital counterpart to the master ticket 14, as depicted in FIG. 2*b*. Thus, in this embodiment, the player can actually play the game embodied by the master ticket 14 on their smart device 34 using the digital game play area 30 without subsequent interaction with the master ticket 14.

Figure 4:
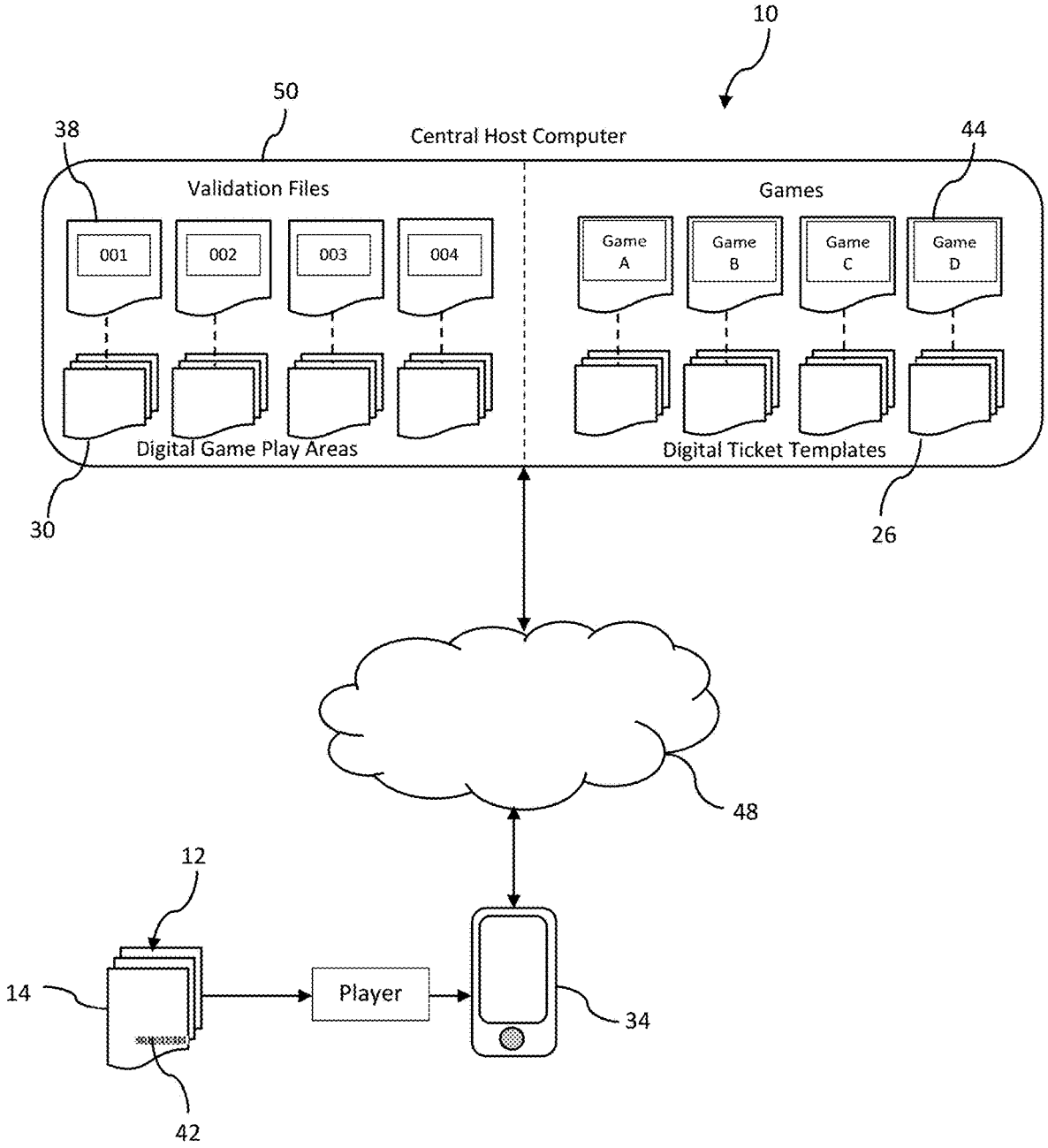
FIG. 4 is a block diagram of a system component and method configuration according to an alternate embodiment of the invention.

In the above embodiment, and with reference to FIG. 4, the ticket-specific code 42 may be the ticket validation code, wherein the separate file 38 is also the validation file associated with the master ticket 14 at the central server 50. Thus, the digital game play areas 30 are also stored in the validation file 38.

The system 10 and method 100, 200 also contemplate that each master ticket 14 may be specifically configured to include an easily recognized symbol 46 printed thereon that indicates to players that one or more of the foreign language digital templates 26 is available for the master ticket 14. For example, such symbol 46 may be a multi-national caricature, similar to the Olympic Games characters and mascots, or any other suitable indicia (including words and/or graphics).

FIGS. 3 and 4 depict the player's smart device 34 in communication with the central (host) server 50 via any suitable communications network 48. The network 48 can be any type of communications network, such as a local area network (e.g. intranet), wide area network (e.g. Internet), or some combination thereof. The network can also include a direct connection between the player mobile device 34 and the host server 50. In general, communication between the host server 50 and player mobile device 34 can be carried via a network interface using any type of wired and/or wireless connection, using a variety of communication protocols (e.g. TCP/IP, HTTP, SMTP, FTP), encodings or formats (e.g. HTML, XML, JSON), and/or protection schemes (e.g. VPN, secure HTTP, SSL).

It should be appreciated that the host server 50 can include a network interface for providing communications over the network 48. A network interface can include any suitable components for interfacing with one more networks, including for example, transmitters, receivers, ports, controllers, antennas, or other suitable components.

The host server 50 can be any computing device and can include one or more processors and one or more computer-readable media. The computer-readable media can store instructions which cause the processor to perform the operations described herein, as well as other functions related to conduct of the overall game for the lottery authority.

The player's smart device 34 can be any portable computing device that can be used by a player to interface with the host server 50. For instance, the device 36 can be a wireless device, a personal digital assistant (PDA), portable gaming device, cellular phone, smart phone, tablet, navigation system, handheld GPS system, wearable computing device, a display having one or more processors, or other such device. In short, the player's smart device 36 can be any computer-device or system that can execute a gaming module to allow a player to interact with the host computer 50 as described herein.

The technology discussed herein makes reference to servers, computers, databases, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, server processes discussed herein may be implemented using a single server or multiple servers working in combination. Databases and applications may be implemented on a single system or distributed across multiple systems. Distributed components may operate sequentially or in parallel.

Figure 5:
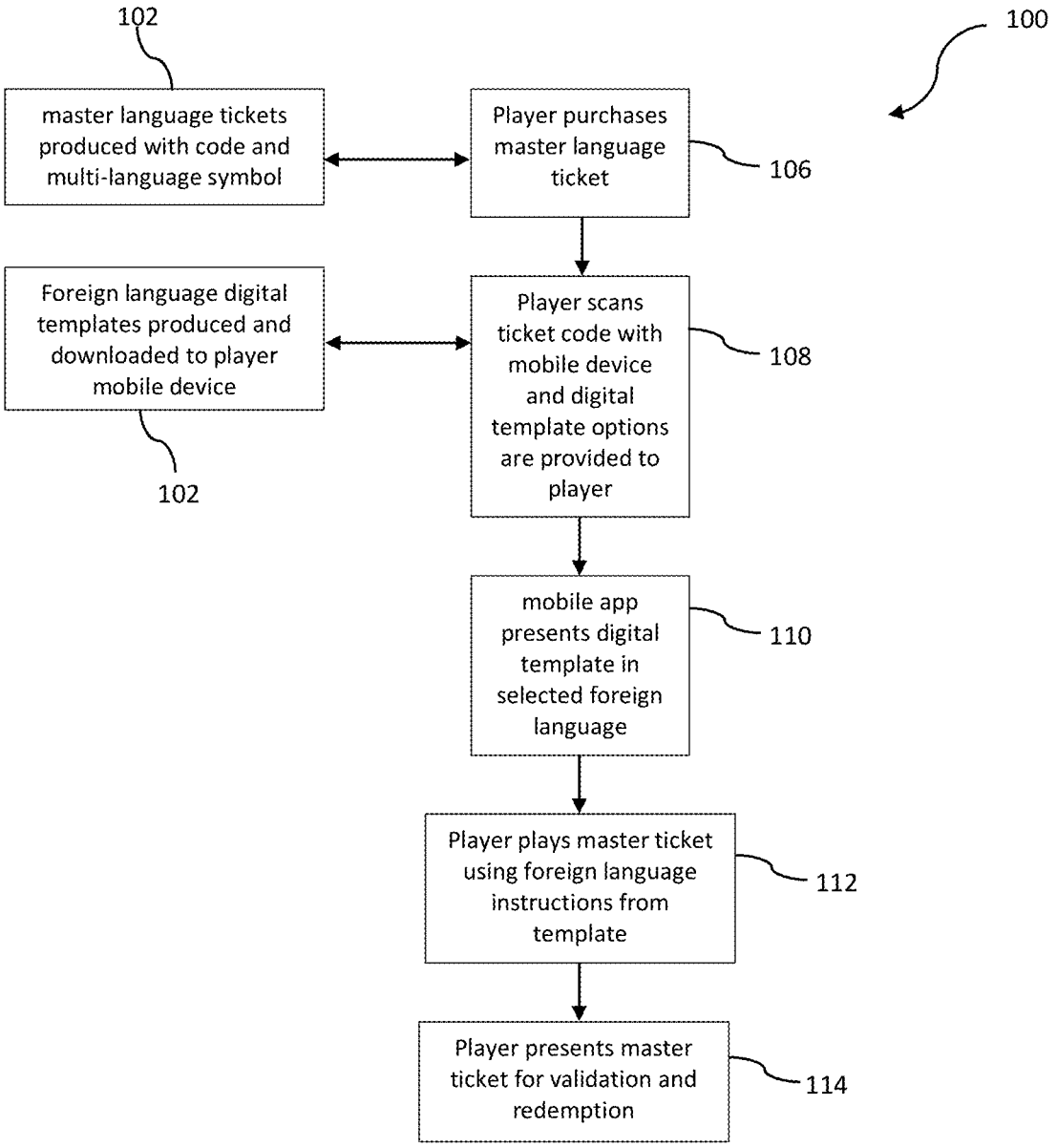
FIG. 5 is a flow diagram according to an embodiment of the invention.

FIG. 5 depicts an embodiment of a method 100, aspects of which are discussed above.

At step 102, the master language tickets 14 are produced with the code 22 and multi-language enabled symbol 46 provided thereon.

Step 104 depicts generation of the foreign language digital templates 26, which are initially stored at the central server 50.

At step 106, the player purchases one or more of the master tickets 14 (paper or electronic).

At step 108, the player scans or otherwise enters the code 22 from the master ticket 14 into their smart device 34 via the application running on the smart device 34. At this time, the foreign-language digital template options are presented to the player via the smart device 34

At step 110, via the application running on the smart device 34, the player is presented with the digital template in foreign-language selected by the player, which may be combined with a generic game play area.

At step 112, the player plays the master ticket 14 with reference to the foreign-language game play instructions provided by the digital template on their smart device.

Step 114 depicts that the player presents the master ticket 14 for validation and redemption of a winning master ticket 14.

Figure 6:
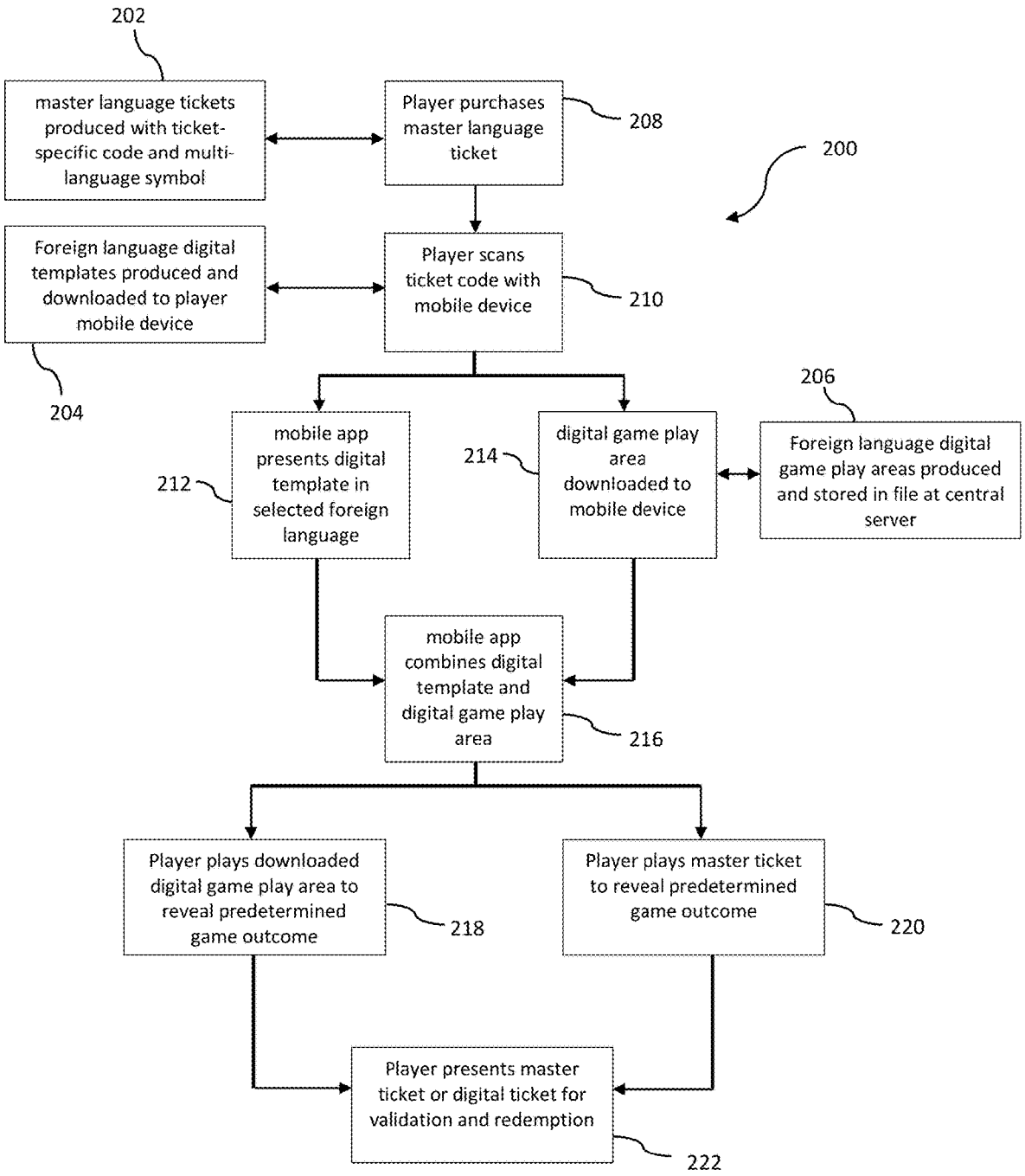
FIG. 6 is a flow diagram according to an alternate embodiment of the invention.

FIG. 6 depicts an embodiment of a method 200 associated with FIGS. 2*a*, 2*b*, and 4.

At step 202, the master language tickets 14 are produced with the ticket-specific code 42 and multi-language enabled symbol 46 provided thereon.

Step 204 depicts generation of the foreign language digital templates 26, which are initially stored at the central server 50.

Step 206 depicts generation of the foreign-language digital game play areas that are unique to each master ticket 14 and are stored in a ticket-specific file (e.g. the validation file) at the central server 50.

At step 208, the player purchases one or more of the master tickets 14 (paper or electronic).

At step 210, the player scans or otherwise enters the ticket-specific code 42 from the master ticket 14 into their smart device 34 via the application running on the smart device 34 and is presented with the foreign-language digital template options.

At step 212, the foreign-language digital template 26 selected by the player is provided to the mobile application from the digital templates 26 stored on the smart device 34 or individually transmitted by the central server 50.

At step 214, the digital game play area 30 corresponding to the foreign language digital template 26 selected by the player is retrieved by the central server 50 from the ticket-specific file 38 (e.g., the validation file) and downloaded to the player's mobile smart device 34.

At step 216, the mobile smart device 34 combines the digital template 26 and corresponding digital game play area 30 into an interactive digital ticket image of the master ticket 14.

At step 218, the player has the option simulate play of the digital ticket image on their mobile smart device 34 to reveal the predetermined outcome of the master ticket 14.

Alternatively, at step 220, the player can simply play the master ticket 14 with reference to the foreign language game play instructions 28 provided by the digital ticket image on their smart device.

At step 222, the player presents the actual master ticket 14 or the digital ticket image on their smart device for validation and redemption of winning master tickets 14.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An instant lottery ticket game system, comprising:

a set of master instant lottery tickets for a common game, wherein each master instant lottery ticket comprises a game play area with variable game play indicia, and static game instruction indicia in a master language, the static game instruction indicia common to all of the master instant lottery tickets in the common game;

each of the master instant lottery tickets further comprising a code thereon that links the master instant lottery ticket to the common game;

for the common game, one or more corresponding digital templates that contain the static game instruction indicia in a foreign language;

a central server that stores the digital templates for the common game, the central server configured for communication with a player's smart device to download the digital templates via an application running on the player's smart device;

the code or a separate code provided on the ticket linking the master instant lottery ticket to a ticket-specific file at the central server, the ticket-specific file comprising a digital game play area corresponding to the game play area on the master instant lottery ticket;

wherein, via the application on their smart device, the player enters one or both of the code and the separate code from the master instant lottery ticket and selects one of the digital templates to view the game instruction indicia in the foreign language of the digital template; and wherein the central server transmits the digital game play area to the player's smart device where the digital game play area is combined with the digital template and presented to the player.

2. The instant lottery ticket game system as in claim 1, wherein the digital templates for the common game are downloaded to and stored on the player's smart device, wherein upon entry of the code to the smart device, the application makes the digital templates available to the player.

3. The instant lottery ticket game system as in claim 1, wherein the digital templates are individually transmitted by the central server to the player's smart device upon receipt by the central server of the code from the player's smart device.

4. The instant lottery ticket game system as in claim 1, wherein the digital templates are presented on the player's smart device as static non-interactive images.

5. The instant lottery ticket game system as in claim 4, wherein the digital templates are presented on the player's smart device as part of a generic instant lottery ticket image for the common game.

6. The instant lottery ticket game system as in claim 1, wherein the code is a game-specific code for the common game and is not specific to individual master instant lottery tickets within the common game, wherein the separate code is provided that is specific to the master instant lottery ticket and links the master instant lottery ticket to the ticket-specific file at the central server.

7. The instant lottery ticket game system as in claim 1, wherein the code is a ticket-specific code that also links the master instant lottery ticket to the ticket-specific file at the central server.

8. The instant lottery ticket game system as in claim 1, wherein the digital game play area is interactive so that the player simulates removal of a scratch-off coating from the digital game play area to reveal a winning or losing status of the master instant lottery ticket.

9. The instant lottery ticket game system as in claim 1, wherein some or all of the variable game play indicia on the master instant lottery ticket is in the master language, the digital game play area further comprising foreign language game play indicia for the foreign language selected by the player.

10. The instant lottery ticket game system as in claim 1, wherein each of the master instant lottery tickets comprises a symbol printed thereon that indicates to players that one or more of the foreign language digital templates are available for the master instant lottery ticket.

11. An instant lottery ticket game system, comprising:

a set of master instant lottery tickets for a common game, wherein each master instant lottery ticket comprises a game play area with variable game play indicia, and static game instruction indicia in a master language, the static game instruction indicia common to all of the master instant lottery tickets in the common game;

each of the master instant lottery tickets further comprising a code thereon that links the master instant lottery ticket to the common game;

for the common game, one or more corresponding digital templates that contain the static game instruction indicia in a foreign language;

a central server that stores the digital templates for the common game, the central server configured for communication with a player's smart device to download the digital templates via an application running on the player's smart device;

wherein, via the application on their smart device, the player enters the code from the master instant lottery ticket and selects one of the digital templates to view the game instruction indicia in the foreign language of the digital template;

wherein the code is a game-specific code for the common game and is not specific to individual master instant lottery tickets within the common game; and wherein each of the master instant lottery tickets further comprises a separate validation code that is linked to a validation file associated with the master instant lottery ticket, the validation file containing ticket-specific information for validation and pay-out on the master instant lottery ticket.

12. An instant lottery ticket game system, comprising:

a set of master instant lottery tickets for a common game, wherein each master instant lottery ticket comprises a game play area with variable game play indicia, and static game instruction indicia in a master language, the static game instruction indicia common to all of the master instant lottery tickets in the common game;

each of the master instant lottery tickets further comprising a code thereon that links the master instant lottery ticket to the common game;

for the common game, one or more corresponding digital templates that contain the static game instruction indicia in a foreign language;

a central server that stores the digital templates for the common game, the central server configured for communication with a player's smart device to download the digital templates via an application running on the player's smart device;

wherein, via the application on their smart device, the player enters the code from the master instant lottery ticket and selects one of the digital templates to view the game instruction indicia in the foreign language of the digital template;

wherein the code is a ticket-specific code that also links the master instant lottery ticket to a ticket-specific file at the central server, the ticket-specific file comprising a digital game play area corresponding to the game play area on the master instant lottery ticket, wherein upon receipt of the ticket-specific code, the central server transmits the digital game play area to the player's smart device where the digital game play area is combined with the digital template and presented to the player; and wherein the ticket-specific code is a validation code that is also linked to a validation file associated with the master instant lottery ticket, the validation file containing ticket-specific information for validation and payout on the master instant lottery ticket, the digital game play area stored in the validation file.

13. A method for providing multi-lingual capability to an instant lottery ticket game system, comprising:

producing a set of master instant lottery tickets for a common game, wherein each master instant lottery ticket comprises a game play area with variable game play indicia, and static game instruction indicia in a master language, the static game instruction indicia common to all of the master instant lottery tickets in the common game;

on each of the master instant lottery tickets, printing a code thereon that links the master instant lottery ticket to the common game;

linking the code or a separate code provided on the master instant lottery ticket to a ticket-specific file at the central server, the ticket-specific file comprising a digital game play area corresponding to the game play area on the master instant lottery ticket;

for the common game, producing one or more corresponding digital templates that contain the static game instruction indicia in a different foreign language;

storing the digital templates at a central server, and downloading the digital templates to a player's smart device via an application running on the player's smart device;

wherein, via the application on their smart device, the player enters one or both of the code and the separate code from the master instant lottery ticket and selects one of the digital templates stored on their smart device or individually transmitted by central server to view the game instruction indicia in the foreign language of the digital template; and wherein the central server transmits the digital game play area to the player's smart device where the digital game play area is combined with the digital template and presented to the player.

14. The method as in claim 13, wherein the digital templates are presented on the player's smart device as static non-interactive images as part of a generic instant lottery ticket image for the common game.

15. The method as in claim 13, wherein the code is a game-specific code for the common game and is not specific to individual master instant lottery tickets within the common game, wherein the separate code is provided that is specific to the master instant lottery ticket and links the master instant lottery ticket to the ticket-specific file at the central server.

16. The method as in claim 13, wherein the code is a ticket-specific code that also links the master instant lottery ticket to the ticket-specific file at the central server.

17. The method as in claim 13, wherein the digital game play area is interactive so that the player simulates removal of a scratch-off coating from the digital game play area to reveal a winning or losing status of the master instant lottery ticket.

18. The method as in claim 13, wherein some or all of the variable game play indicia on the master instant lottery ticket is in the master language, the digital game play area further comprising foreign language game play indicia for the foreign language selected by the player.

* * * * *